US007449655B2

(12) United States Patent
Cowling et al.

(10) Patent No.: US 7,449,655 B2
(45) Date of Patent: Nov. 11, 2008

(54) APPARATUS FOR, AND METHOD OF, CLASSIFYING OBJECTS IN A WASTE STREAM

(75) Inventors: Donald Cowling, Farnborough (GB); Peter Neil Randall, Farnborough (GB)

(73) Assignee: Qinetiq Limited (GB)

( * ) Notice: Subject to any disclaimer, the term of this patent is extended or adjusted under 35 U.S.C. 154(b) by 173 days.

(21) Appl. No.: 10/572,161

(22) PCT Filed: Sep. 20, 2004

(86) PCT No.: PCT/GB2004/004032

§ 371 (c)(1),
(2), (4) Date: Mar. 16, 2006

(87) PCT Pub. No.: WO2005/028128

PCT Pub. Date: Mar. 31, 2005

(65) Prior Publication Data

US 2007/0029232 A1 Feb. 8, 2007

(30) Foreign Application Priority Data

Sep. 20, 2003 (GB) ..... 0322043.1

(51) Int. Cl.
*B07C 5/00* (2006.01)

(52) U.S. Cl. ..... 209/577; 209/578; 209/579; 209/580

(58) Field of Classification Search ..... 209/576, 209/577, 578, 579, 587, 588, 939
See application file for complete search history.

(56) References Cited

U.S. PATENT DOCUMENTS

| | | | | |
|---|---|---|---|---|
| 3,747,755 | A * | 7/1973 | Senturia et al. | 209/559 |
| 5,260,576 | A | 11/1993 | Sommer, Jr. et al. | |
| 5,397,004 | A | 3/1995 | Kaiser et al. | |
| 5,539,517 | A * | 7/1996 | Cabib et al. | 356/456 |
| 5,615,778 | A * | 4/1997 | Kaiser et al. | 209/578 |
| 6,313,423 | B1 | 11/2001 | Rich et al. | |
| 6,373,568 | B1 * | 4/2002 | Miller et al. | 356/326 |
| 6,504,943 | B1 * | 1/2003 | Sweatt et al. | 382/103 |
| 6,637,600 | B2 * | 10/2003 | Miyamoto et al. | 209/539 |
| 6,639,665 | B2 * | 10/2003 | Poole | 356/300 |
| 6,771,400 | B2 * | 8/2004 | Kleiman | 358/505 |
| 2002/0135760 | A1 | 9/2002 | Poole | |

FOREIGN PATENT DOCUMENTS

| | | |
|---|---|---|
| CA | 2110733 | 12/1992 |
| DE | 43 05 006 | 9/1993 |
| DE | 43 40 795 | 3/1995 |

(Continued)

*Primary Examiner*—Patrick H Mackey
*Assistant Examiner*—Kalyanavenkateshware Kum
(74) *Attorney, Agent, or Firm*—McDonnell Boehnen Hulbert & Berghoff LLP

(57) ABSTRACT

Apparatus for classifying objects in an input waste stream comprises a hyperspectral sensor, means for moving objects in the input waste stream relative to the sensor and through a sensing region thereof, and processing means for classifying objects in the input waste stream on the basis of signals output from the hyperspectral sensor to the processing means. The apparatus allows classification of objects composed of one of a wide range of materials and also provides for discrimination of objects comprising different grades of the same material.

16 Claims, 1 Drawing Sheet

FOREIGN PATENT DOCUMENTS

| | | |
|---|---|---|
| DE | 101 43 394 | 3/2003 |
| EP | 0 554 850 | 8/1993 |
| EP | 1 026 486 | 8/2000 |
| GB | 2 284 477 | 6/1995 |
| WO | WO 00/57160 | 9/2000 |

* cited by examiner

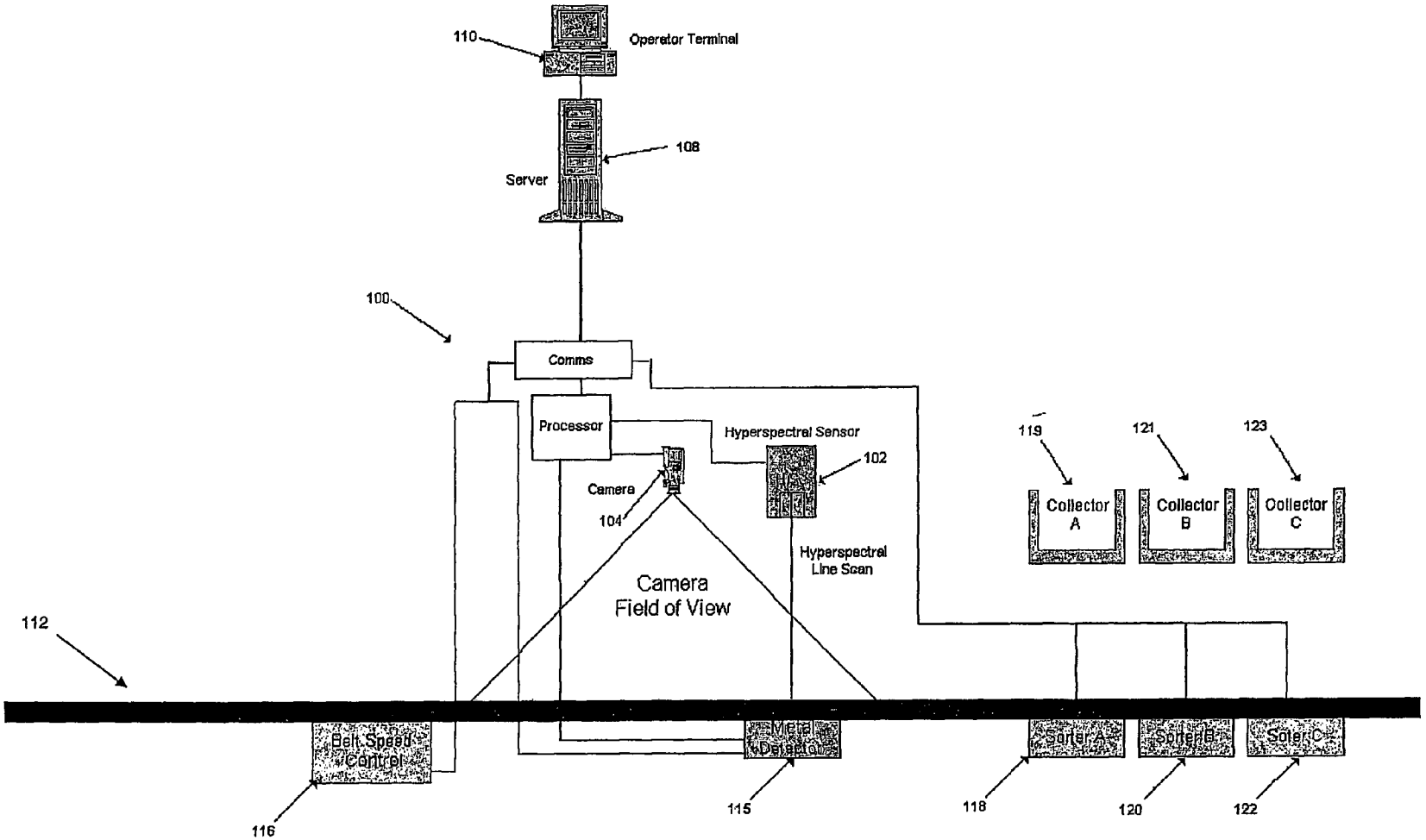
Operator Terminal
110
108
Server
100
Comms
Processor
Hyperspectral Sensor
102
Hyperspectral Line Scan
Camera
104
Camera Field of View
Collector A
119
Collector B
121
Collector C
123
Sorter A
118
Sorter B
120
Sorter C
122
Metal Detector
115
Belt Speed Control
116
112

APPARATUS FOR, AND METHOD OF, CLASSIFYING OBJECTS IN A WASTE STREAM

BACKGROUND OF THE INVENTION (1) Field of the Invention

The invention relates to the use of hyperspectral sensing and classification techniques, originally developed for defence applications, for the automated identification and sorting of household waste. Reclaimed material may then be recycled. The application is for general household waste and does not cover types of waste with specific hazards, e.g. nuclear waste. However, the invention could be adapted to other waste streams or sorting applications.

(2) Description of the Art

Household waste is currently sorted in Material Reclamation Facilities (MRFs). These generally use mechanical devices to achieve sorting of waste types based on material or object properties such as size. For example, a trommel (a rotating drum with holes) can be used to separate containers from paper and film waste. These devices are generally rather crude and cannot sort different grades of the same material, eg different types of plastic or coloured glass. Manual sorting is widely used in MRFs to achieve separation of plastics, glass, and paper or to achieve quality control by removal of contaminating items from separated streams of such materials. In recent years, some higher technology equipment has been developed but such instances tend to be focussed at sorting one specific material at a time. For example, high-density polyethylene (HDPE) from a mixed plastics stream, followed by polypropylene (PP) extraction from the same stream and so on.

There are now a number of systems that carry out automated identification and sorting systems for material reclamation processes. Most employ some form of near-infrared identification process for material classification and an air ejection process to sort the identified objects. These types of systems are primarily focused at specific material types and have generally only successfully been applied to plastics sorting where they are used to sort different types of plastic from one another. These systems are, therefore, dependent on some form of upstream processing to sort plastics from mixed household waste before the technology can be applied.

In addition to sorting plastics into their main types, some of these systems will also sort plastics by colour and may even remove cartons if present within the waste stream.

U.S. Pat. No. 5,260,576 refers to a technique for measuring the transmittance of objects using X-ray radiation, however the technique has only been successfully applied to plastic containers, rather than a wide range of materials.

Published European patent application number EP 1 026 486 discloses a relay lens system allowing an object to be illuminated by a source, and the reflected radiation collected in one of two ways, according to whether the reflection from the object is diffuse or specular in nature. This system is intended for sorting plastic materials only for recycling, rather than sorting objects of a variety of different materials, such as is found in general domestic waste.

Published European patent application EP 0 554 850 describes a method of classifying plastic objects based on measuring the infra-red transmission of the objects. The method is not applicable to other classes of waste.

Existing sensing technologies can only identify and classify a limited range of materials. Some systems exist for classifying materials within a class, e.g. different plastics, but these systems have been optimised for that task and would be unable, for example, to identify an aluminium can mixed in with other waste.

Certain systems exist which use a small number of wavelength bands to image and then classify materials, for example that described in US patent application 2002/0135760 images in only three or four wavelength bands, which is sufficient to achieve the purpose of that system, namely simple distinguishing of contaminated (dirty) chicken carcasses and uncontaminated (clean) carcasses. However such a multispectral system would be unable to distinguish a large number of different material types.

SUMMARY OF THE INVENTION

It is an object of the present invention to ameliorate the above-mentioned problems. According to a first aspect of the present invention, this object is achieved by apparatus for classifying objects in a waste stream, the apparatus comprising a sensor, means for moving objects in the waste stream relative to the sensor and through a sensing region thereof, and processing means for classifying objects in the waste stream on the basis of signals output from the sensor to the processing means, characterised in that the sensor is a hyperspectral sensor.

The waste stream may be moved with respect to a static hyperspectral sensor; alternatively the hyperspectral sensor may be moved with respect to a static stream of waste.

A further advantage of a system of the present invention is that the cost of hyperspectral sensors with the required spatial resolution capability is relatively modest and standard, low cost, illumination sources (white light and/or mid infrared) can be used.

A hyperspectral sensor provides data signals from which it is possible to identify a far greater range of materials seen in a typical household waste stream and, therefore, offers increased performance over more conventional types of sensors utilised in Material Reclamation Facilities such as near infra-red sensors. Hyperspectral technologies offer far greater flexibility by being able to identify a wide range of materials with common sensor technology. Existing processes rely on a range of technologies as well as human intervention to sort household waste. Such technologies include electromagnets, eddy current separators, mechanical size discrimination, near infra-red identification of plastics, X-ray detection of PVC and glass. Hyperspectral technology also offers the potential to discriminate colour (e.g. coloured glass).

Hyperspectral detection uses a material's spectral signature for identification. By measuring the energy reflected, transmitted, or emitted from a material with a hyperspectral imaging system it is possible to classify or identify a material based on its spectral fingerprint to a level not possible using a conventional colour camera or thermal imager.

A hyperspectral sensor functions as a radiant-energy device for determining the spectral radiance for each area of an object irradiated by a light-source. Hyperspectral imaging techniques (HIT) can utilise many (e.g. hundreds) contiguous narrow wavebands covering the spectral signature of the object. Spatial and radiance data are collected via imaging and spectral sampling equipment (e.g. a prism). Either or both reflective and emissive modes may be employed and the information gathered may be presented in the form of a data cube with two dimensions to represent the spatial information and the third as the spectral dimension. Data reduction routines (such as principal component analysis or data sparsing by wavelet), traditional target detection, change detection and classification procedures are then applied for spatial signature analysis.

Preferably the apparatus further comprises a broadband camera arranged to generate pixellated image data of a region of the input waste stream prior to the pixellated region being sensed by the hyperspectral sensor and to provide said pixellated image data to the processing means, and wherein the processing means is arranged to (i) classify material within each pixel of the pixellated image data using said image data and signals output from the hyperspectral sensor;

(ii) associate a group of contiguous pixels identified as involving the same material with an object; and (iii) associate a material with the object.

This facilitates classification by providing for classification of a material type using hyperspectral data corresponding to a particular pixel, and subsequent classification of an object material based on classified outputs for each pixel within an image of that object.

Classification of objects made from a wide range of materials, and also classification of objects into different grades of a single material, may be carried out by performing spectral signature analysis using the pixellated image data and signals output from the hyperspectral sensor.

Preferably, the processing means is arranged to perform spectral signature analysis by means of the Support Vector Machine (SVM) algorithm because this algorithm provides reliable classification even with sparse data. The SVM may be enhanced by introducing a confidence measure which allows a measure of confidence to be attached to each pixel classification. If a particularly high purity of a sorted class is required, then a confidence level may be set to accept only pixels which are classified with a pre-determined minimum level of confidence. The level may be adjusted in operation of the system. In addition to pixel-level material classification, a confidence level may also be applied during object classification.

Output data corresponding to the material, shape, colour, orientation, position in the waste stream and time of identification of classified objects is preferably output from the processing means as data packets each of which corresponds with an object in the input stream to allow efficient reclamation of classified objects.

The detection efficiency of the system is not greatly affected by the presence of objects with different composite materials, but proportionally large areas of contaminated surface may mislead the object identification. This potential problem may be addressed by fusing data from the hyperspectral sensor with additional inputs. For example, the classification process may be made more reliable by fusing data from the hyperspectral sensor with data from other sensors, such as a metal detector array.

The operational waveband of a hyperspectral sensor can be from the visible (VIS) through to the long-wave infra-red (LWIR). Experimental measurements indicate that the visible/short-wave infra-red (VIS/SWIR) region is more useful than the medium-wave infra-redlong-wave infra-red (MWIR/LWIR) region for discriminating individual materials and for sorting coloured glass. Tests also suggest that the MWIR/LWIR region is more suited for discriminating between polymer-coated and non-coated glasses and provides more separability between other material and plastic and glass classes. For the purposes of this specification, the regions of the electromagnetic spectrum mentioned above are defined as follows:

Visible: 0.38-0.78 μm

Near IR: 0.78-1.0 μm

Shortwave IR: 1.0-3.0 μm

Midwave IR: 3.0-5.0 μm

Longwave IR: 7.5-14.0 μm.

For the purposes of this specification 'hyperspectral' refers to ten or more spectral bands, whereas 'multi-spectral' refers to less than ten spectral bands. Classification performance and capability is improved if imaging is carried out in 100 or more spectral bands.

Current commercial automated systems consist of both an identification stage and a sorting stage. The identification stages of most commercial systems are based on near infra-red identification systems, which exploit the absorption characteristics of the material in the near infra-red spectrum. These types of systems are limited to processing/sorting of plastics and are, therefore, limited in the range of materials that they can process. Systems of the present invention differ from known automated systems in that they are able to identify and classify a wider range of materials. Typical types of materials that need to be identified in a household waste stream are metals, plastics, paper, glass and some composite materials such as Tetra Pak® containers. Systems of the present invention are able to differentiate between different types of materials as well as being able to differentiate different classes within each material type (e.g. different types of plastic). They can also discriminate different coloured items (e.g. glass bottles). Integrating a hyperspectral sensor into a sorting unit to give an automated system provides a mass sorting capability that is lacking in the prior art.

Apparatus of the present invention is able to sort a greater range of material recyclates automatically. The number of processes within a Material Reclamation Facility (MRF) may be reduced as a consequence of the present invention and, therefore, potential savings can be made with reduced operating costs, reduced staff costs from reduced dependence on manual sorting, and reduced health & safety risks. Additionally, and dependent on the functionality of a particular system of the present invention, quality levels can be set for the system output streams. As a result of their automated nature, systems of the present invention yield better quality control on the recovered material, which in turn enables MRFs to sell reclaimed material at a higher price or secure more regular contracts. At present many batches of reclaimed material are rejected by reprocessors because of quality problems.

A second aspect of the present invention provides a method of classifying objects in a waste stream, characterised in that the method comprises the steps of (i) moving objects in the waste stream relative to a sensor and through a sensing region thereof; and (ii) classifying objects in the input waste stream on the basis of signals output from the sensor to the processing means;

characterised in that the sensor is a hyperspectral sensor.

A further aspect of the invention provides a method of identifying a material comprised in an object on the basis of image data generated from hyperspectral imaging of the object, said method comprising the step of implementing the Support Vector Machine algorithm with said image data as input data.

DESCRIPTION OF THE FIGURES

Embodiments of the invention are described below with reference to the accompanying drawing which shows a system of the invention indicated generally by 100.

DETAILED DESCRIPTION OF THE INVENTION

The system 100 is able to discriminate between different material types as well as identify different material classes in a mixed household waste stream, and eject objects of a pre-determined material-type for recycling. The system 100 comprises a hyperspectral camera 102, and conventional broadband camera, the output of which is connected to a processor 108. Monitoring and control of the system 100 is carried out by means of a computer 112 which is connected to the processor 108 and which has an operator terminal 110. The system 100 further comprises a conveyor belt 112, the speed of which is controlled by control unit 116, and ejection units 118, 120, 122 for ejecting objects from a waste stream on the conveyor belt 112 and passing them to corresponding receptacles 119, 121, 123. The ejection units 118,120, 122 may be based on known rejection systems such as flap gates or air separators. Further ejection units may be added as required depending on the number of material classes to be sorted. The hyperspectral camera 102 images in 128 spectral bands in the bandwidth 0.9 to 1.76 μm, but only data in 98 bands in the bandwidth ~0.94 to ~1.6 μm is processed by the processor 108. A metal detector array 115 may be arranged to output further data to the processor 108.

The system 100 operates as follows. A mixed waste stream, comprising objects which are to be identified, classified and extracted/reclaimed from the waste stream, is input to the system 100 on the conveyor belt 112. Camera 104, which is positioned slightly 'upstream' of the hyperspectral camera 102, scans the input waste stream and outputs pixellated image data to the processor 108. Data from the camera 104 also provides tracking functionality to determine where objects are on the conveyor belt 112.

The processor 108 is programmed inter alia to segment image data output by the camera 104 with a high degree of confidence. The waste stream is then scanned by the hyperspectral camera 102 and data thus generated is also output to the processor 108 which operates to associate each pixel scanned by the hyperspectral camera 102 with a particular material and with a particular waste object in the input waste stream.

The processor 108 executes a classification algorithm comprising two main classification stages:

(i) for each pixel, classification of the material type based on the hyperspectral data obtained for that pixel; and (ii) classification of an object material based on the classification of each pixel within the segmented image for that object.

Pixels which fall outside of the segmented image boundaries are ignored as they can be assumed to be background and not target material.

Once an object in the input waste stream has been classified and characterised in terms of object material, shape, location, colour, orientation and position, the processor 108 generates a data packet corresponding to these features. The data packet is assessed by the computer 112 together with the belt speed, and a control signal is passed from the computer 112 via a data communications network to one of the ejection units 118, 120, 122 interfaced with the server 108 so that the object is ejected into on of the receptacles 119, 121, 123 which corresponds to the material-type or material-grade of the object.

Data input to the processor 108 from the cameras 102, 104 is reduced by suitable techniques to retain the key information whilst allowing processing in real time. A classification algorithm implemented on the processor 108 then processes this information in order to give a prediction of the material type. The processor 108 need not be programmed to perform shape or template matching, although it may be programmed to carry out logical tests in order to prevent incorrect identifications.

The detection efficiency of the system 100 is not greatly affected by the presence of objects with different composite materials, but proportionally large areas of contaminated surface may mislead the object identification. This potential problem is addressed by fusing data from the hyperspectral camera 102 with additional inputs. For example, the classification process may be made more reliable by fusing data from the hyperspectral camera 102 with data from other sensors, such as a metal detector array 115.

The classification algorithm is applied to data output by the hyperspectral camera 102 to identify materials from their spectral characteristics. The algorithm uses a classification technique known in the prior art as the 'Support Vector Machine' (SVM), which is a public-domain algorithm for classification. Other classifiers may also be used but the SVM is particularly effective in performing classification with sparse or limited data.

A Support Vector Machine (SVM) is a learning technique based on the mathematically rigorous statistical learning theory (see for example V. N. Vapnik, 'The Statistical Nature of Learning Theory' ISBN 0-387-98780-0.) It uses historical data to train the algorithm to recognise future data collected. This process involves the construction of a model of the relationship between the inputs and outputs based on the information in the data. The best solutions make use of the available information without over-specialising on "training data"; some algorithms over train in this manner, reducing their predictive capability. SVMs provide a well-defined way of controlling this trade-off based on statistical learning theory, which is lacking in other techniques such as neural networks. This allows SVMs to provide better generalisation.

The particular algorithm implemented by the system 100 uses a particular method to solve a quadratic optimisation problem that arises when solving the SVM. The method is called 'Sequential Minimal Optimisation', and is described in detail in the paper "Sequential Minimal Optimization: A Fast Algorithm for Training Support Vector Machines", by J. Platt in the Microsoft Research Technical Report MSR-TR-98-14, (1998).

The SVM algorithm may be trained as follows. Initially, data is collected from the hyperspectral sensor across the entire optical band at high spectral resolution, using sample objects of known composition. The data is divided into four segments corresponding to available sensor technology, and the spectral resolution is reduced in steps by averaging data from adjacent sub-bands.

In the system 100, the processor 108 operates to find an overall classification for an object based on the proportion of each material type identified. For example, a steel food can may show 90% paper due to the label and 10% steel, but should be classified as a steel item. Classification rules implemented by the processor 108 may be optimised once a large number of objects may been processed by the system 100.

Although the system 100 is trained to identify a specific range of materials, an ability to identify new materials may be added by collecting training data from the hyperspectral sensor 102 and re-training the SVM algorithm to re-define class boundaries. New SVM parameters thus generated are then used when the system 100 is operational. Software patches may be generated in a laboratory and provided to operational systems such as 100.

The SVM may be enhanced by introducing a confidence measure which allows a measure of confidence to be attached to each pixel classification. If a particularly high purity of a sorted class is required, then a confidence level may be set to accept only pixels which are classified with a pre-determined minimum level of confidence. The level may be adjusted in operation of the system 100. In addition to pixel-level material classification, a confidence level may also be applied during object classification.

The orientation and surface geometry of an object in the input mixed waste stream may affect the absolute reflectance, but has little impact on spectral features. Hence, a comparison of spectral features is more robust than simply comparing absolute values. This is especially true in the case of specular materials whose optical properties are strongly dependent upon orientation. However, some reliance on absolute values may be required to discriminate between materials with few or no features. Illumination of the waste objects is important as illumination sources positioned incorrectly can generate high degrees of reflectance or shadows which may confuse the object segmentation algorithms executed on the server 108.

The present invention is primarily aimed at the material reclamation industry, focusing on domestic waste separation and sorting. However, the technique could be adapted to other areas where a range of materials needs to be identified. For example, sorting of residue from fridge shredding, car shredding, or waste electrical equipment, or potentially sorting of organic objects such as fruit and vegetables, or compostable waste.

The resolution required of the hyperspectral camera 102 in order to distinguish features and to discriminate between the materials is between 5 and 10 nm. Overall, the region considered to give the highest potential to correctly classify a range of material types including steel, aluminium, paper, card, glasses, plastics and Tetra Pak® containers is considered to be the SWIR. Other bands will also work, and in some cases work better for certain subsets of materials.

The invention claimed is:

1. An apparatus for classifying objects in a mixed waste stream including multiple material types, the apparatus comprising;

a sensor wherein the sensor is a hyperspectral sensor responsive in at least ten spectral bands;

a conveyor for moving objects in the waste stream relative to the sensor and through a sensing region thereof;

a processor for classifying objects of multiple material types in the waste stream on the basis of signals output from the sensor to the processor; and a broadband camera arranged to generate pixellated image data of a region of the input waste stream and to provide said pixellated image data to the processor, and wherein the processor is arranged to (i) classify material within each pixel of the pixellated image data using the pixellated image data and signals output from the hyperspectral sensor;

(ii) associate a group of contiguous pixels identified as involving the same material with an object; and (iii) associate a material with the object and wherein the processor is arranged to identify material within each pixel of the pixellated image data by performing spectral signature analysis by means of a Support Vector Machine algorithm using said image data and signals output from the hyperspectral sensor.

2. The apparatus according to claim 1 wherein the processor is arranged to classify material within a pixel as belonging to a certain material-type only when said material has been identified with a minimum level of confidence.

3. The apparatus according to claim 2 wherein the processor is arranged to output data corresponding to the material, shape, color, orientation, position in the waste stream and time of identification of classified objects as data packets each of which corresponds to an object in the input stream.

4. The apparatus according to claim 1 wherein the apparatus further comprises a metal detector array and the processor is arranged to classify material on the basis of data output from both the hyperspectral sensor and the metal detector array.

5. The apparatus according to any preceding claim wherein the hyperspectral sensor is responsive in the short-wave infra-red band of the electromagnetic spectrum.

6. The apparatus according to claim 1 wherein the hyperspectral sensor is responsive in 100 or more wavelength bands.

7. A method of classifying objects in a mixed waste stream including multiple material types, comprising the steps of:

(i) moving objects in the waste stream relative to a sensor, wherein the sensor is a hyperspectral sensor responsive in at least ten spectral bands, and through a sensing region thereof; and (ii) classifying objects of multiple material types in the waste stream on the basis of signals output from the sensor to the processing means by the further steps of;

(1) generating pixellated image data of a region of the waste stream;

(2) classifying material within each pixel of the pixellated image data by spectral signature analysis by means of a Support Vector Machine algorithm using said image data and signals output from the hyperspectral sensor;

(3) associating a group of contiguous pixels identified as involving the same material with an object; and (4) associating a material with the object.

8. The method of claim 7 wherein material within a pixel is classified as belonging to a certain material-type only when said material has been identified with a minimum level of confidence.

9. The method of claim 8 farther comprising the step of outputting a data packet corresponding to the material, shape, colour, orientation, position in the waste stream and time of identification of a classified object in the input stream.

10. The method of claim 7 wherein classification is carried out using output data from a hyperspectral sensor and from a metal detector array.

11. A method according to claim 7 wherein classification is carried out by analysis of radiation received from the objects in the short-wave infra-red band of the electromagnetic spectrum.

12. A method according to claim 7 wherein classification is carried out by analysis of radiation received from objects in 100 or more wavelength bands.

13. Apparatus according to claim 1, wherein said mixed waste stream includes papers and plastics, and wherein said processing means classifies both paper and plastics on the basis of signals output from the hyperspectral sensor.

14. Apparatus according to claim 1, wherein the operational waveband of the hyperspectral sensor includes the range from 0.94 μm to 1.6 μm.

15. The method according to claim 7, wherein said mixed waste stream includes papers and plastics, and wherein both papers and plastics are classified on the basis of signals output from the hyperspectral sensor.

16. The method according to claim 7 wherein the operational waveband of the hyperspectral sensor includes the range from 0.94 μm to 1.6 μm.

* * * * *